United States Patent [19]

Ribaud et al.

[11] 4,445,816

[45] May 1, 1984

[54] SUPERSONIC COMPRESSOR WITH IMPROVED OPERATION RANGE

[75] Inventors: Yves J. Ribaud; Gilbert F. Kergreis, both of Palaiseau, France

[73] Assignee: Office National D'Etudes et de Recherches Aerospatiales, Sous-Bagneux, France

[21] Appl. No.: 282,608

[22] Filed: Jul. 13, 1981

[30] Foreign Application Priority Data

Jul. 16, 1980 [FR] France ..... 80 15716

[51] Int. Cl.[3] ..... F04D 29/44

[52] U.S. Cl. ..... 415/181; 415/211

[58] Field of Search ..... 415/119, 181, 207, 211, 415/DIG. 1

[56] References Cited

U.S. PATENT DOCUMENTS 3,904,308 9/1975 Ribaud ..... 415/181

4,131,389 12/1978 Perrone et al. ..... 415/DIG. 1

4,164,845 8/1979 Exley et al. ..... 415/207

*Primary Examiner*—Harvey C. Hornsby

*Assistant Examiner*—Arthur D. Dahlberg

*Attorney, Agent, or Firm*—Larson and Taylor

[57] ABSTRACT

A supersonic centrifugal compressor comprises a bladed rotor which delivers fluid at an absolute velocity exceeding Mach 1.2 under rated conditions to an annular radial flow diffuser. The diffuser has a casing including spaced sidewalls and vanes defining intervane channels each having a throat section located downstream of the leading edges of the channel defining vanes. A pair of common secondary spaces are formed each in one of said sidewalls and communicate with parietal slots symmetrically formed in the sidewalls and opening into the channels. The slots are located and dimensioned to overlap the throat section in the flow direction and each has a cross-sectional flow area at least equal to half the flow area of the channel at the throat.

8 Claims, 13 Drawing Figures

SUPERSONIC COMPRESSOR WITH IMPROVED OPERATION RANGE

BACKGROUND AND SUMMARY OF THE INVENTION

The present invention relates to supersonic compressors of the type comprising a channel diffuser and a rotor or impeller designed to supply fluid at an absolute velocity at least equal to Mach 1.2 to the diffuser at the design operating point, the diffuser comprising a plurality of vanes supported by a casing, distributed at evenly angular intervals and defining intervane channels having a throat section located downstream of the leading edges of the vanes.

The invention is particularly suitable for use in the field of centrifugal compressors which are practically the only ones presently used for delivering a supersonic flow to the stator portion of the compressor. Reference will consequently be made to such centrifugal compressors. However, the invention may also be applied to diffusers forming stator rings for axial compressors receiving a supersonic flow and having a high pressure ratio per stage, typically greater than 2.

Supersonic centrifugal compressors may be designed to deliver a high flow rate per unit front area and may achieve high compression rates, possibly exceeding 10. However, such result is conditioned by high circumferential speeds, typically of about 600 m/s at the blade tips for air compression rates of about 10.

Such high specific flow rate (ratio of volume flow rate to the frontal sectional area of the disc of the rotor) and compression rate (for example 10) can be attained only with a relative speed at the tips of the blades at the rotor input which is highly supersonic. In the case contemplated and in the case of a rotor having blades which exhibit a ratio between the output radius and the input tip radius equal to 1.5, the relative input Mach number at the blade tip will be of about 1.3.

The existence at the input of the diffuser of zones where the absolute speed is supersonic strongly limits the range of variations of the volume flow rate which may be accepted by the diffuser and consequently the volume flow rate range at the input to the compressor. The existence of zones where the relative speed is supersonic at the input of the rotor also limits the volume flow rate range, but the latter limitation is less stringent than the first one when the flow is primed at the throat of the intervane channels in the diffuser.

The impact of the first limitation is such that, as soon as Mach numbers exceeding about 1.25 are reached at the input of the diffuser, the extent of the volume flow rate range is drastically reduced and the compressor can only operate at one predetermined flow rate.

It is an object of the invention to provide an improved supersonic compressor, particularly a centrifugal compressor in which the diffuser receives fluid at a speed typically exceeding a Mach number of 1.2 under rated or design conditions, which has an extended flow rate range. It is another object of the invention to provide a centrifugal compression whose rotor has characteristics of self matching to the diffuser when the compressor operates under variable flow rate conditions.

For that purpose, the invention includes a compressor of the above-defined type in which each intervane channel of the diffuser has two parietal slots whose length in the flow direction is such that they extend on each side of the throat section of the channel, all slots situated on the same side of the channel communicating with a common volume through passages whose cross-sectional area is at least equal to that of the slots throughout the length of the passages.

The invention will be better understood from the following description of particular embodiments thereof, given by way of examples only, and from the comprison which is made with the prior art.

SHORT DESCRIPTION OF THE DRAWINGS

Figure 1:
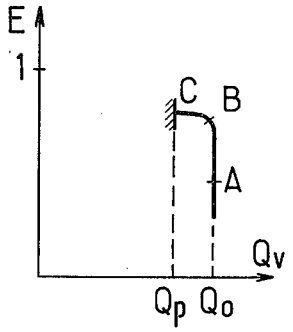
FIG. 1 is a graph of the variation in efficiency E (ratio between the static output pressure and the total input pressure of a conventional diffuser plotted against the volume flow rate $Q_v$ at the input, under unprimed operation of the diffuser.
Figure 3:
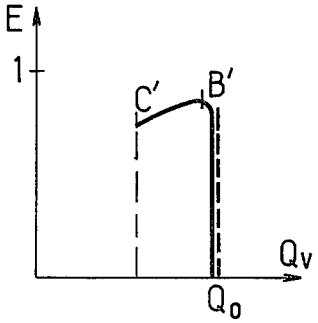
Figure 10:
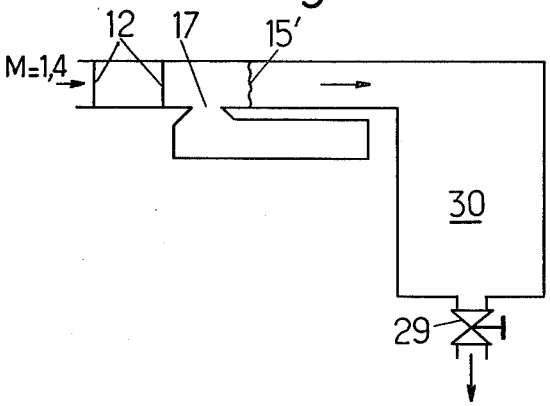
Figure 12:
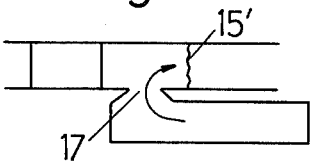
Figure 11:
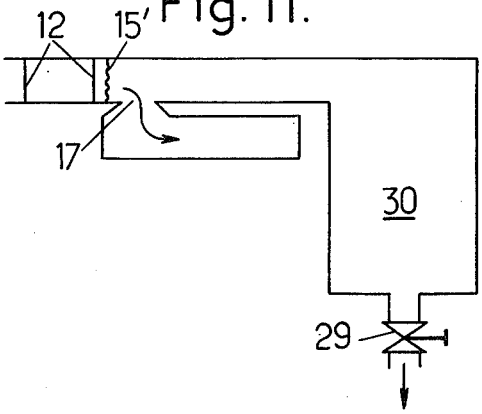
Figure 13:
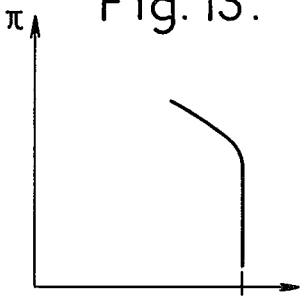
Figure 2:
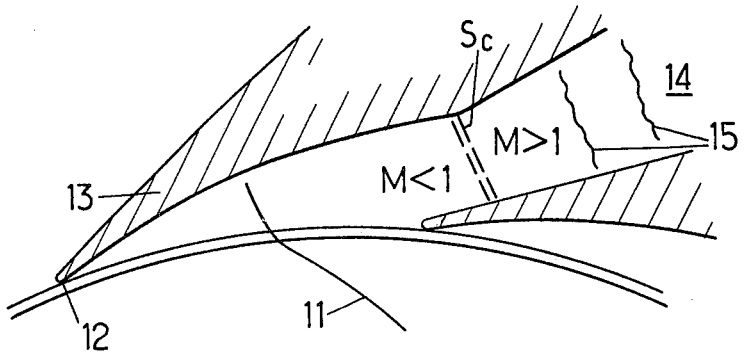
FIG. 2 is a diagram illustrating flow conditions in a conventional diffuser, under unprimed operating conditions, at limit flow.
Figure 4:
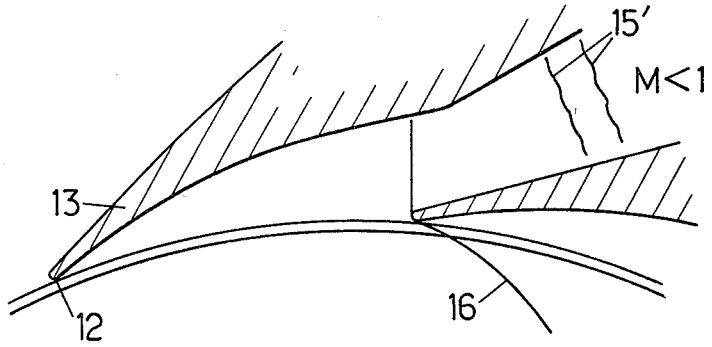
Figure 5:
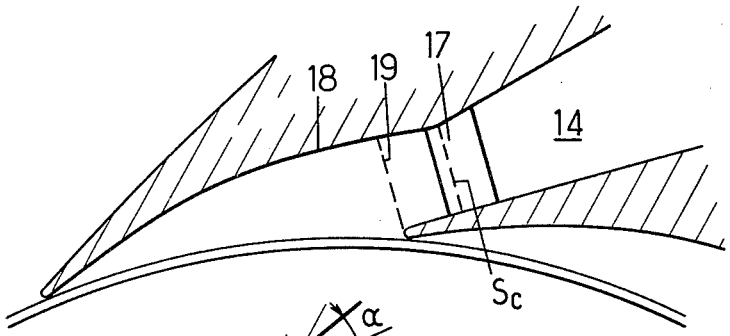
Figure 6:
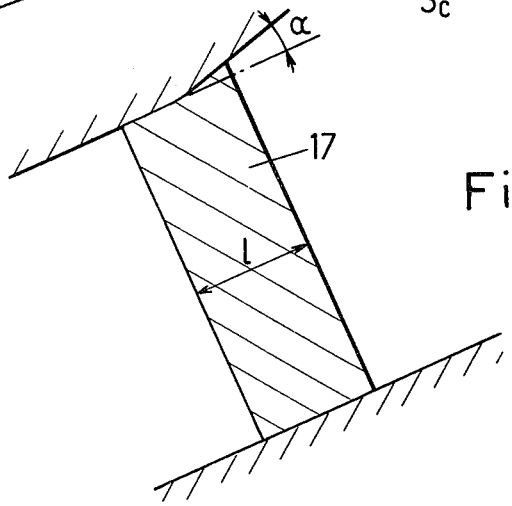
Figure 7:
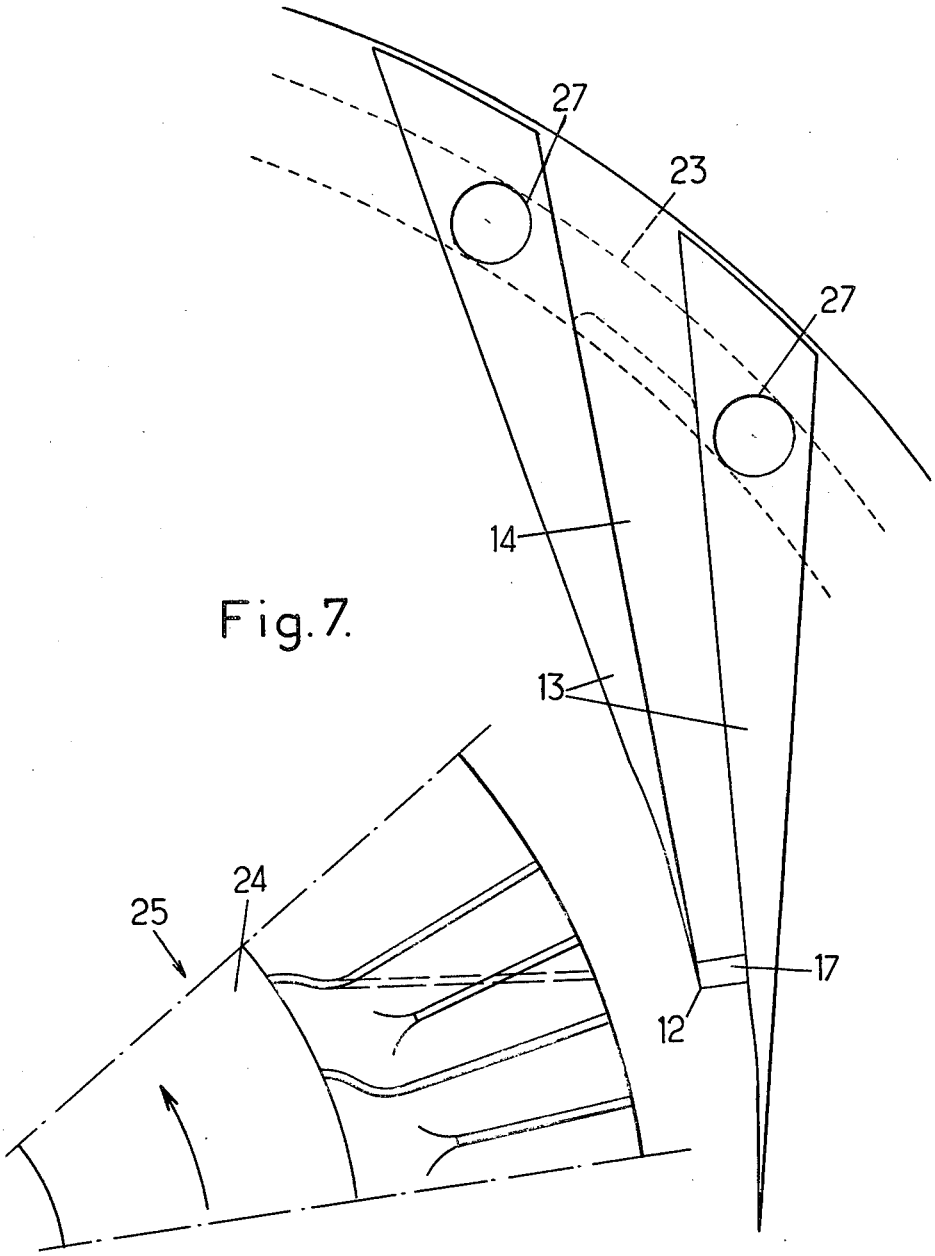
Figure 8:
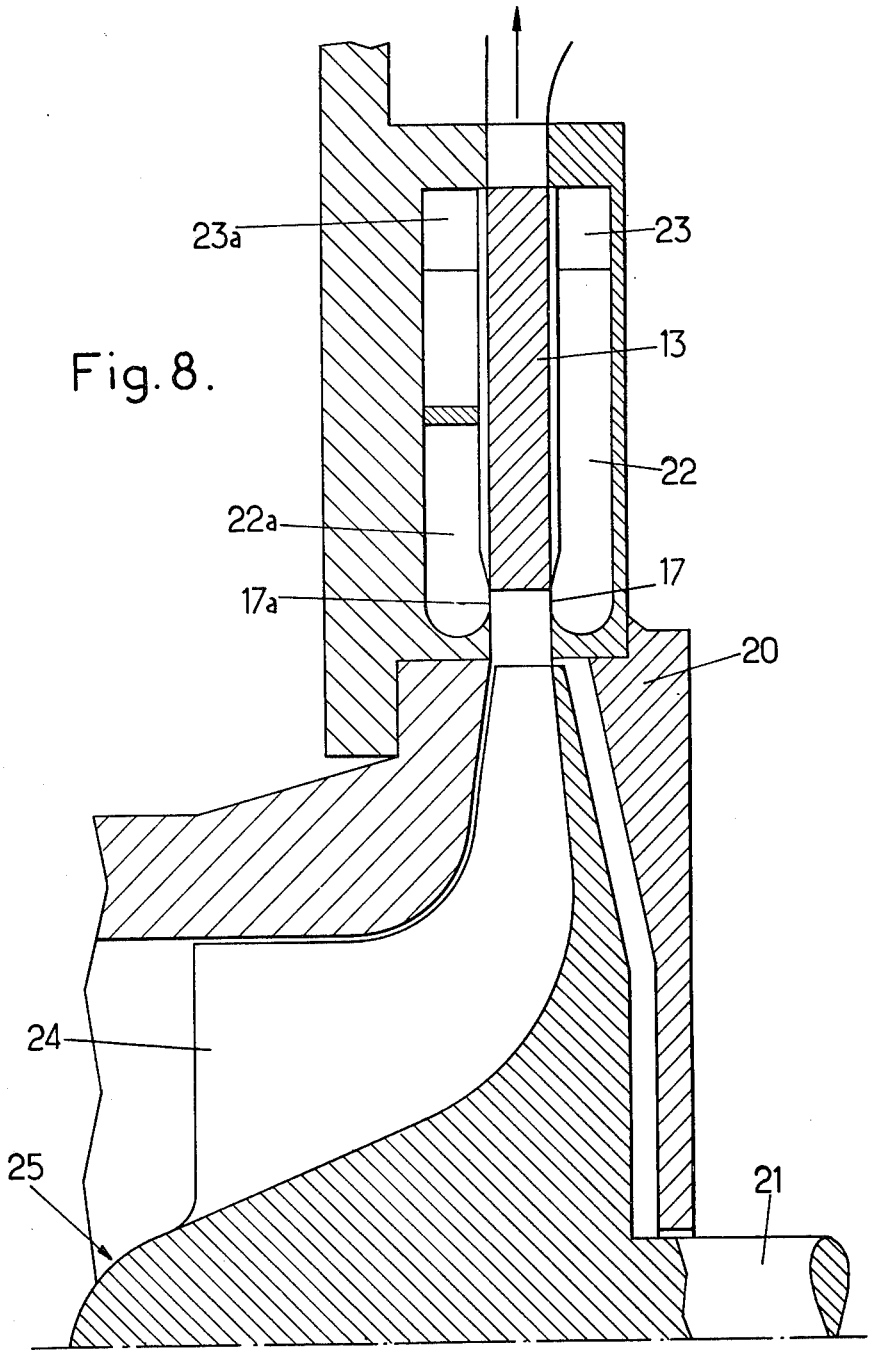
Figure 9:
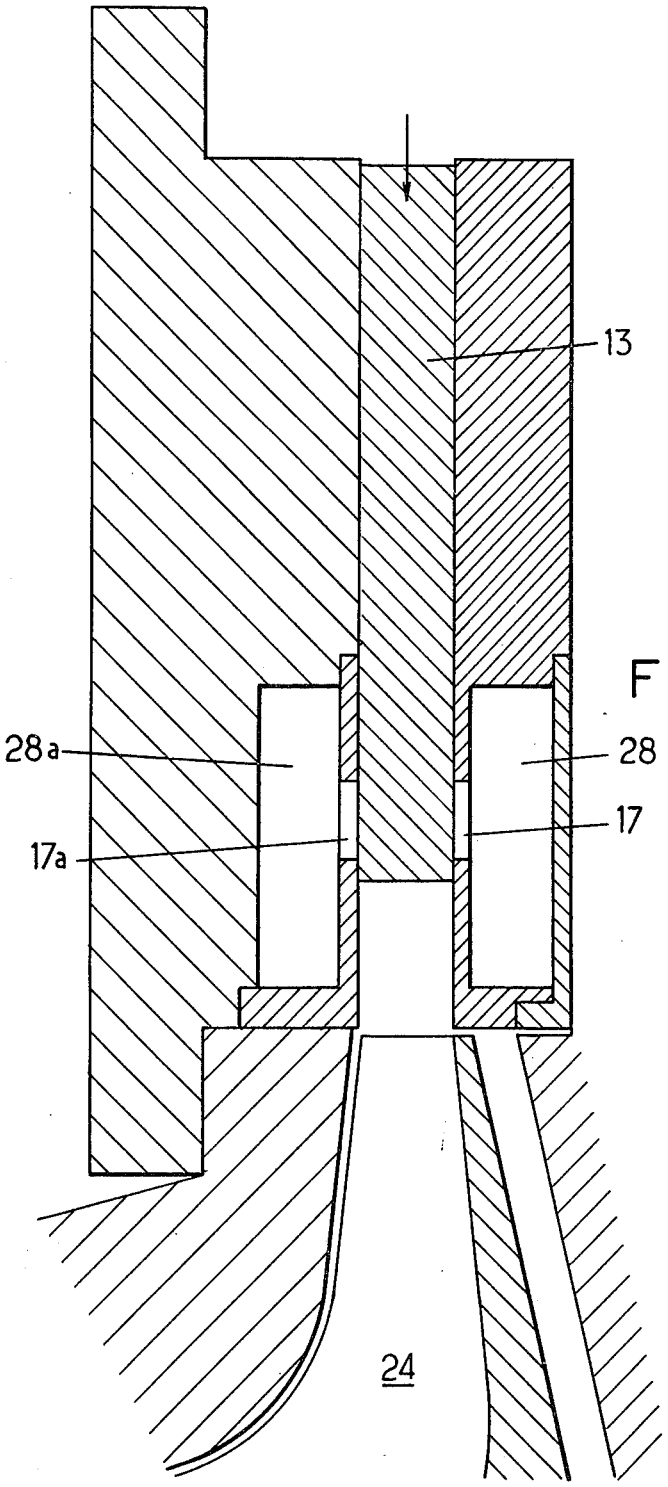

FIGS. 3 and 4, similar to FIGS. 1 and 2, correspond to primed operation;

FIG. 5, similar to FIGS. 2 and 4, shows the arrangement of a slot in a compressor in accordance with the invention;

FIG. 6 shows a detail of FIG. 5 at an enlarged scale;

FIGS. 7 and 8 are schematic views, respectively in cross-section along a flow surface and along a meridian plane, illustrating a first embodiment of the invention;

FIG. 9, similar to FIG. 8, illustrates a second embodiment;

FIG. 10 is a simplified diagram showing the position of the recompression shock wave with respect to the slots, in a compressor in accordance with the invention, under steady operation conditions;

FIGS. 11 and 12, similar to FIG. 10, show successive positions taken by the recompression shock under unstationary operating conditions;

FIG. 13 is a curve representing the variation of the pressure ratio of a rotary compressor as a function of the standardized flow rate.

DETAILED DESCRIPTION OF PARTICULAR EMBODIMENTS

For a better understanding of the invention, the flow conditions encountered in a supersonic compressor and the factors which limit the flow rate range will first be summarized.

The flow configuration in the input zone of the channel diffuser of a centrifugal supersonic compressor changes considerably when the input Mach number increases beyond about 1.25.

As long as the Mach number remains moderate, for example of about 1.2, the curve illustrating the variation of the efficiency E of the diffuser with respect to the input volume flow rate has the shape shown in FIG. 1. There exists a possible range for volume flow rate variation, typically of about 8%, extending from the maximum flow rate $Q_O$ to the surge flow rate $Q_p$. Under that flow rate, there appears, flow instabilities detrimentally affecting operation of the compressor.

In this mode of operation, shock waves 11 appear upstream of the leading edges 12 of blades 13. Across the shock wave 11, the flow decreases to subsonic velocity (FIG. 2). The operation of the diffuser is then said to be unprimed.

The maximum or limit flow rate $Q_O$ corresponds to appearance of sonic conditions in the throat section of the diffuser. For that limit flow rate (A for instance in FIG. 1), the flow again becomes supersonic in the divergent part of the intervane channel 14, i.e. from the throat section $S_c$, until the appearance of pseudo recompression shocks whose position and strength depend on the counterpressure which may be adjusted with an output valve of the diffuser. Downstream of these pseudoshocks 14, the speed is again subsonic.

As long as the flow is sonic at the throat, the conditions upstream thereof, particularly the position of the shock wave 11, upstream of the vanes, remain invariable.

When the counterpressure is further increased by throttling the valve, the recompression shocks 15 move upstream and their strength is decreased. For a sufficient counterpressure, the shocks disappear at the throat; further increase causes the flow to exhibit a Mach number in the throat section which is less than 1 and is gradually decreased. The volume flow range of the diffuser is also gradually decreased (BC on the curve of FIG. 1). But the unpriming shocks 11 then oscillate about a position of equilibrium which becomes more and more precarious until surge appears at flow rate $Q_p$.

If, on the other hand, the Mach number at the input of the diffuser is higher than previously, for example higher than 1.25, the input flow is supersonic at least as far as the throat section of the diffuser and therefore remains supersonic in the portion of the divergent zone of the diffuser between the throat and the pseudo recompression shocks 15'. The diffuser is then said to be primed. In the upstream zone of the diffuser there then appear oblique shock waves 16 attached to the leading edges 12 and of low strength. The volume flow rate of the compressor is then invariable and the characteristic E ($Q_v$) is that shown with a broken line in FIG. 3. When the recompression shock 15' moves to the vicinity of the throat due to an increase of the counterpressure, its strength remains finite and it is not possible to switch by steady reduction of flow rate $Q_v$, from the primed flow diagram to the unprimed flow diagram. Any additional increase in the counterpressure causes the recompression shock to move out of the diffuser in the upstream direction and surge immediately occurs.

Only when the Mach number is close to the borderline between primed flow and unprimed flow, for approximately Mach 1.25, the existence of a turbulent boundary layer at the throat, having a thickness depending on the counterpressure, allows the unpriming shock to be stable in a flow rate range which is however very small, not exceeding 5%.

On the other hand, the rotor exhibits a volume flow rate range which is much higher than that of the diffuser, for the relative input speed is fairly different at the tips of the blades, where it is supersonic, and the foot of the blade, where it is frequently subsonic (respectively M 1.4 and M 0.7 for example). The volume flow rate variation range is often of the order of 30%. Though that range is lesser than in transonic and subsonic rotors, it remains however sufficient for many applications and anyway it appears that the limitation of the flow rate range is due essentially to the diffuser.

There will now be described different solutions in accordance with the invention, for increasing the flow rate range of a diffuser of the type shown in FIGS. 2 and 4.

All embodiments comprise, for each channel 14, two parietal slots placed to overlap and straddle the aerodynamic throat. This throat may not exactly coincide with the geometrical throat due to the increasing thickness of the boundary layer in the flow direction. It is however always very close thereto and, considering the length required for the slots in the flow direction, the condition is always fulfilled if the slot is substantially symmetrical with respect to the geometrical throat. FIGS. 5 and 6 show a possible position of a slot 17. The latter is located rearward of the input zone of the diffuser (corresponding to the part of the outer surface 18 which is beyond the next vane) defined by the broken line 19 and overlaps the zone of the throat where the channel has parallel faces or a very small angle of divergence (up to 2° for example) so as to compensate for the thickening of the limit layer. Slot 17 also extends beyond throat section over a small portion of divergent part of the channel, the divergence $\alpha$ of which is typically of about 5°.

Each slot 17 extends over the whole width of the channel. The length L in the flow direction is equal to or greater than half of the height of the stream in the diffuser. Thus the total flow cross sectional area offered by slots 17 will be at least equal to the minimum flow cross-sectional area of the diffuser. The latter will typically be constructed so that the length of the throat zone, from line 19 to the minimum cross-sectional area $S_c$, is approximately equal to half the width of the channel at the end of the input zone.

The slots situated on the same side of the channel communicate with a same damping volume. In the embodiment shown in FIGS. 7 and 8, the damping volume associated with each set of two slots comprises two secondary channels parallel to the intervane channel, i.e. slightly divergent. The secondary channels are connected by annular chambers on each side of the diffuser.

Referring to FIGS. 7 and 8, slots 17 on the side of rotor 25 which is adjacent to shaft 21 each open into a secondary channel 22 formed in the casing 20 of the compressor. All secondary channels 22 open into a peripheral annular chamber 23 common to all channels.

Similarly, the slots **17*a* on the side 24 of the rotor 25 open into secondary channels 22*a* which open into a peripheral annular chamber 23*a*. Passages 27 (FIG. 7) connect the annular groove 23 and 23*a*. In a modified embodiment, the passages 27** are omitted.

The flow cross-sectional area of the passages connecting the slots to each other is selected so that no shock wave occurs therein. For that purpose, the flow cross-sections at all locations along the passages are at least equal to the flow cross-section of the slot. Moreover, each set of slots 17, **17*a* is typically provided for diverting the whole of the flow which passes through the corresponding intervane channel 14 during short periods of time. Then, the two slots have a cumulate flow cross-section greater than that of the channel at the throat, typically 20% greater. It is furthermore desirable that slots 17 and 17*a*** are at least approximately symmetrical with respect to the mid plane of the channel.

In the modified embodiment illustrated in FIG. 9, slots 17 and **17*a* do not open into secondary channels, but into respective secondary annular volumes 28 and 28*a*** defined by planes perpendicular to the axis of rotation of the rotor. The volumes are again formed in the casing, on the shaft side of the rotor and on the input side of the rotor, and are connected by passages having a cross-sectional flow area at least equal to that of the slots.

In both embodiments, the secondary volume will have a size having the same order of magnitude which will be typically about six-thousandths of the volume downstream of the diffuser (i.e. up to the valve for adjusting the counterpressure or up to the distributor of the gas turbine, if the compressor feeds a gas turbine).

In FIG. 7, the rotor has blades which are radially directed in the output zone thereof. Such an arrangement is satisfactory for operation at speeds above the rated speed. Except if the rotor speed is variable and the rotor is for frequent operation at overspeeds, while it is at limit flow, it will be advantageous to direct the endmost part of the blades rearwards of the direction of rotation by an angle at least equal to 30°, as shown in broken lines in FIG. 7.

Tests carried out on a supersonic centrifugal compressor built in accordance with the invention have shown that the presence of slots 17 and secondary damping volumes forming buffer means substantially increases the volume flow rate range of the diffuser under primed flow operating conditions. The volume flow rate range in operation, which is practically nonexistent in the absence of slots under primed operating conditions, has a value of the order of 40%, as shown by the continuous line in FIG. 3. On the other hand, the slots do not substantially modify the maximum volume flow rate $Q_O$, or the maximum efficiency E for the limit volume flow rate.

In practice, the existence of a volume flow rate range results in numerous advantages over conventional supersonic compressors:

Since, in a conventional compressor, the characteristic curve is vertical (FIG. 3), it is necessary for safety reasons to operate the compressor at a compression rate lower, typically by about 10%, than that which corresponds to surge. For example, if the compression rate is 10 when surge occurs, with an isentropic efficiency of 0.75, the operating point will generally be selected so that the compression rate is 9.09 and the efficiency 0.708. The invention allows this safety margin to be overcome and there will be a gain of about 10% on the pressure ratio and 4.2% on the degree of efficiency.

During operation at the rated speed during which the rotor and the diffuser have a satisfactory aerodynamic matching, if the machine is correctly designed, the invention provides a considerable operating range. The range will be increased if the angle of inclination of the blades of rotor 25 in the output zone of the rotor is greater; an angle of 45° is often of advantage.

If the compressor operates at variable speed, and particularly if at overspeed for a fraction of time, under choked flow conditions in the rotor (the term "choked" signifying that the maximum flow rate delivered by the rotor for a predetermined speed of rotation is reached), the invention increases the pressure ratio and the efficiency; such increase is particularly important if the rotor is not matched to the diffuser at such overspeed. In practice, the increase of the pressure ratio may reach 25% and that of the efficiency about 30%.

Apparently, the favourable results obtained by the invention may be explained as follows, it being understood that the validity of the patent should not be conditioned by the complete rightness of the hypotheses.

It will be assumed for simplicity that the compressor considered is of centrifugal type, having a rotor whose relative input Mach number is about 1.3 at the blade tip. It will further be assumed that the absolute Mach number at the input of the diffuser is about 1.4: the flow is then primed.

In a compressor having no slots, the operating conditions are those illustrated in FIG. 3. Surge occurs as soon as the reduction of the cross-sectional flow area of the counterpressure valve has moved the recompression shock wave 15' upstream to a point such that the shock wave is located at the throat $S_c$ of the intervane channel 14.

If the diffuser has slots and secondary volumes in accordance with the invention, the change in the operating conditions is that which will now be described with reference to FIGS. 10, 11 and 12.

If the counterpressure valve 29 is sufficiently open for the recompression shock valve 15' to be located downstream of slots 17 (FIG. 10), the operating conditions are substantially as in a conventional compressor. The recompression shock wave 15' is in stable position, related to a low value of the pressure in the volume 30 which is defined by the diffuser and valve 29. In the example mentioned above, the corresponding static pressure will be about $0.3\pi$, where $\pi$ represents the total (or stagnation) pressure upstream of the diffuser.

If it is now assumed that the flow is constricted by partially closing valve 29, the shock 15' moves slightly upstream of slot 17, but remains downstream of the throat (FIG. 11). The main flow (i.e. towards the downstream volume 30) in front of the slot 17 is then at a pressure equal to about 0.7. The difference between the pressure in the main flow and the pressure in the secondary volumes, where a static pressure of $0.3\pi$ prevails, is such that slots 17 form, during a short period of time $\delta t$, sonic throats through which a greater part of the main flow enters the secondary volume.

During that period of time, the counterpressure valve 29, which also forms a sonic throat due to the high pressure ratio between the downstream volume and the outside is flowed by a constant ejection flow rate. Then, the pressure in the downstream volume 30 slightly decreases because the fluid delivered by the rotor to the diffuser no longer balances the fluid flow through valve 29. The pressure reduction moves shock 15' back to a position downstream of slot 17. As soon as the recompression shock has passed downstream of slot 17, an additional flow rate flows out of the secondary volume into the diffuser channel, as shown by an arrow in FIG. 12. The pressure in the downstream volume 30 tends again to increase and to move shock 15' back upstream of the slot.

It will be appreciated that a value of the counterpressure, which would lead to surge in the absence of the invention, results in oscillation of the recompression shock between the sides of slot 17, such operating conditions avoiding surge.

For the phenomenon to be stable, conditions must be fulfilled. The curve of variation of the compression ratio of the compression stage (rotor-diffuser assembly) responsive to variations of the standardized flow rate must have a negative slope, as shown in FIG. 13. Since the curve illustrating the variations of the efficiency E of the diffuser in accordance with the invention with respect to the volume flow rate $Q_v$ has a positive slope in region C'B' corresponding to oscillation of the recompression shock about the slot (FIG. 3), that condition can be fulfilled only if the curve of the pressure ratio supplied by the rotor plotted against the standardized or "reduced" flow rate has a sufficiently negative slope. For that, it is advisable to lay back the rotor blades, as shown in FIG. 7. However, the condition is inherently fulfilled when the rotor operates under choked flow conditions, which will in general be the case during overspeed operation.

Tests carried out on actual compressors with a rotor operating under choked flow conditions have shown that slots in accordance with the invention made it possible to increase the pressure ratio, typically from 7.45 to 9.3 in a specific example; the volume flow rate range of the diffuser was consequently widely increased, typically from 0% to 40%.

The invention is not limited to the particular embodiments which have been shown and described by way of examples and it must be understood that the scope of the present patent extends to the modifications which will appear to those familiar with the art to which the invention relates. In particular, each slot may be divided into several separate elemental openings located close to each other to increase the rigidity of the diffuser providing that the parts remaining between the opening fragments have a small size in the longitudinal direction of the flow.

We claim:

1. A supersonic centrifugal compressor, comprising:

a bladed rotor arranged to deliver fluid at an absolute velocity at least equal to Mach 1.2 under rated conditions, and an annular radial flow diffuser at the outer periphery of said rotor, having:

a casing including spaced sidewalls and vanes between said spaced sidewalls, cooperating therewith to define intervane channels distributed angularly about an axis of said diffuser and each having a throat section located downstream of the leading edges of the channel defining vanes, a pair of common secondary spaces formed each in one of said sidewalls, a pair of parietal slots per channel, symmetrically formed in said sidewalls, opening into said channel, located and dimensioned to overlap said throat section in the flow direction and to have a cross-sectional flow area at least equal to half the flow area of the channel at the throat thereof, and passage means for communicating the slots formed in a same sidewall to a same one of said common secondary spaces, the cross-sectional flow area of said passage means being at least equal to that of the associated slot throughout its length whereby the flow range is substantially increased.

2. A compressor according to claim 1, wherein each said slot is substantially symmetrical with respect to the geometrical throat of an associated one of said interblade channels.

3. A compressor according to claim 1, wherein each said slot occupies the whole of the width of the associated channel and the length thereof in the direction of the flow is at least equal to half the height of the flow cross-sectional area.

4. A compressor according to claim 1, wherein each said secondary space associated with a set of slots comprises a secondary channel for each slot, all said secondary channels being connected by an annular chamber.

5. A compressor according to claim 1, wherein each said secondary space is formed by a chamber defined by planes perpendicular to the axis of rotation, provided in the casing of the diffuser and opening into the interblade channels through the slots.

6. A compressor according to claim 1, wherein the two spaces associated with the two sets of slots are connected by passages through the vanes of the diffuser.

7. A compressor according to claim 1 or 2 wherein the secondary spaces represent a fraction equal to about 0.6% of the volume downstream of the diffuser.

8. A compressor according to claim 1 or 2 wherein the rotor has blades whose rearward slope in the output zone is at least 30°.

* * * * *